United States Patent [19]

Brouthers

[11] 4,304,061

[45] Dec. 8, 1981

[54] FIREARM BARREL, SHROUD CONSTRUCTION

[75] Inventor: Paul E. Brouthers, Monson, Mass.

[73] Assignee: D.W.A. Associates, Inc., Monson, Mass.

[21] Appl. No.: 41,247

[22] Filed: May 21, 1979

[51] Int. Cl.[3] ..... F41C 1/00; F41C 21/10

[52] U.S. Cl. ..... 42/59; 42/77

[58] Field of Search ..... 42/59, 76 R, 77

[56] References Cited

U.S. PATENT DOCUMENTS

| | | | |
|---|---|---|---|
| 1,127,268 | 2/1915 | Malster | 42/76 R |
| 1,759,772 | 5/1930 | Williams | 42/77 |
| 2,516,926 | 8/1950 | Simpson | 42/76 R |
| 2,976,638 | 3/1961 | Owens | 42/77 |
| 3,303,594 | 2/1967 | Lewis | 42/59 |
| 4,058,050 | 11/1977 | Brouthers | 89/14 C |

FOREIGN PATENT DOCUMENTS

| | | | |
|---|---|---|---|
| 190836 | 8/1956 | Austria | 42/76 R |

*Primary Examiner*—Charles T. Jordan

*Attorney, Agent, or Firm*—Wolf, Greenfield & Sacks

[57] ABSTRACT

The hand gun has a barrel tht may threadedly be supported from the hand gun frame and which is covered by a shroud surrounding the barrel and extending substantially the entire length of the barrel from the frame to the barrel end. A barrel to shroud nut secures the shroud in place about the barrel and against the frame and has a conical or spherical surface in engaged cooperation with a like conical or spherical seat in the shroud to accurately concentrically align the barrel within the shroud to provide more accurate firing and in particular rapid firing.

13 Claims, 5 Drawing Figures

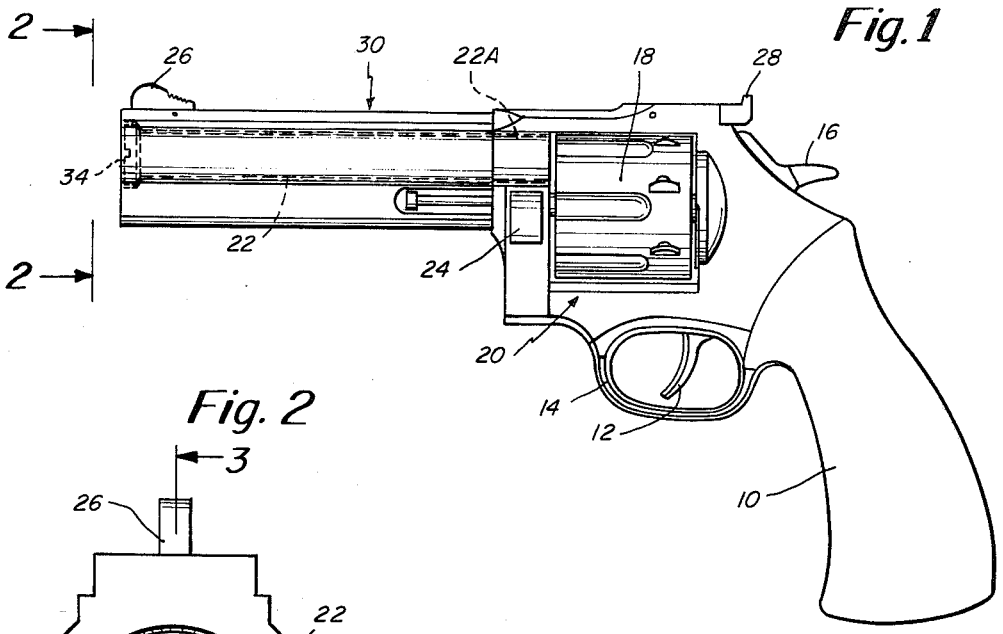
Fig. 1
Fig. 2
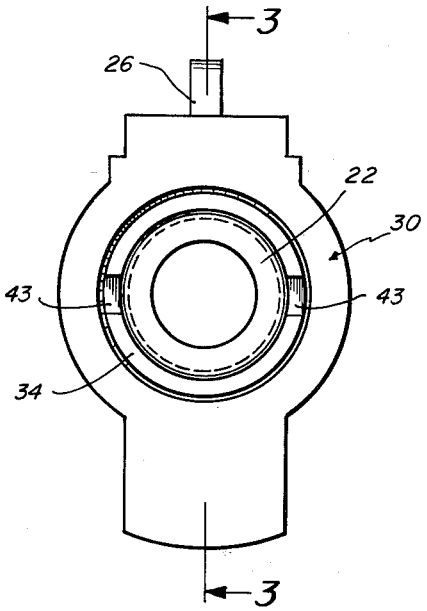
Fig. 4
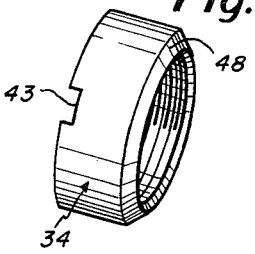
Fig. 3
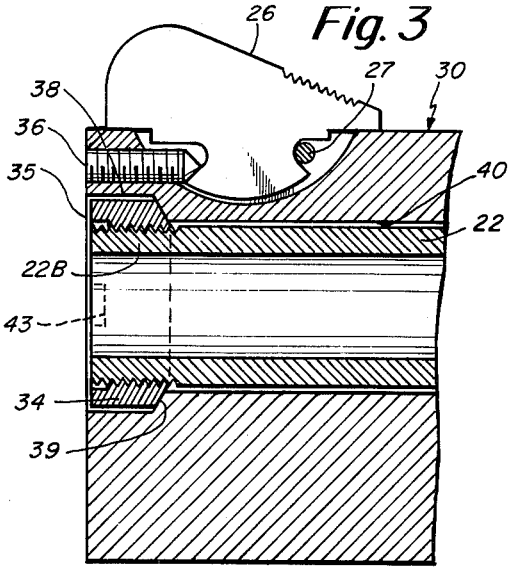
Fig. 5
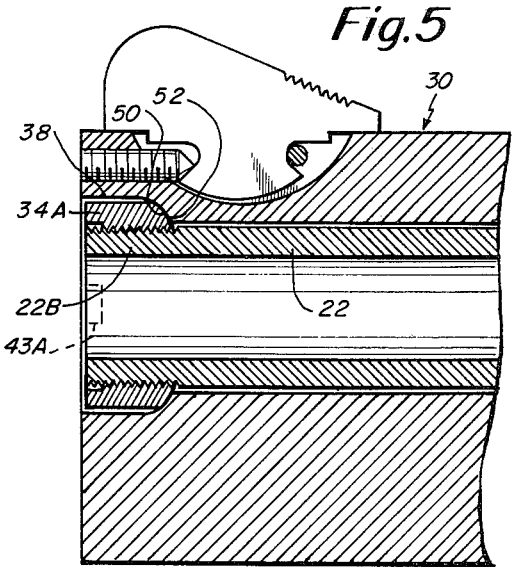

FIREARM BARREL, SHROUD CONSTRUCTION

BACKGROUND OF THE INVENTION

The present invention pertains in general to an improved firearm barrel, shroud construction and, more particularly, to a barrel-shroud nut of improved construction for maintaining the concentricity of the barrel relative to the shroud.

It is common in prior art hand guns to provide a relatively tight and intimate fit between the barrel outer diameter and the shroud inner diameter. For example, one patent showing a barrel and shroud arrangement is the Lewis U.S. Pat. No. 3,303,594 which employs a flanged barrel. In the Lewis patent and in other prior art patents such as U.S. Pat. No. 4,058,050, there are no means provided for accurately centering the barrel in the shroud. It has now been discovered by way of extensive testing that there is an interaction between the barrel and shroud during firing. During firing there is relative motion between the barrel and shroud along the barrel-shroud axis. With the use of prior art arrangements such as those described in the two above-mentioned patents, a relative shift occurs in an axial sense between the shroud and barrel contact surfaces, thus providing unpredictable bullet dispersion from the firearm. With the prior art arrangements, although the clearance between the barrel and shroud is quite small, this axial displacement between the barrel and shroud can cause misalignment therebetween and thus effect the bullet dispersion.

After extensive testing, it has been found that the accuracy of firing and in particular of rapid firing is effected by this lack of concentricity between the barrel and shroud bore. There may also be caused a contact between the outer diameter of the barrel and the inner diameter of the shroud bore. It has been found that this contact, even though it may be localized, effects the accuracy of firing or in other words, the point of impact of the projectile.

Accordingly, one object of the present invention is to provide an improved barrel, shroud construction, wherein the barrel is maintained concentric relative to the shroud bore to improve the accuracy of firing and in particular, rapid firing of the firearm.

When a hand gun, especially one of heavy magnum caliber is fired, many events occur within the weapon. In addition, especially at rapid firing there is a tendency for the barrel to heat and thus expand. These factors make it difficult to maintain a precise accuracy of firing from bullet to bullet. For example, when a hand gun of heavy magnum caliber is fired, a bullet of say 150–250 grain weight is accelerated under peak pressures of 40,000–50,000 lbs. per sq. in. pressure out of the cylinder and into the barrel. This causes an engraving of the outside of the bullet with the rifling of the barrel forcing the bullet down and out of the barrel. During firing the hand gun experiences a tremendous shock which establishes vibrations and bending moments in the hand gun. It is during this actual firing cycle that we are maintaining the barrel and shroud components in a uniform position and in that way enhancing the accuracy of the weapon. If accurate concentricity is not maintained, then there may be locations along the barrel where there is contact at its outer diameter with the inner diameter of the shroud. These local points of contact between the barrel and shroud effect the point of impact of the projectile. Therefore, one purpose of the invention is to maintain this concentricity even during rapid firing.

With prior art arrangements not employing the principles of the present invention, the barrel may seat at its outer end in different relationship to the shroud after each firing. This, along with the quite close tolerance of the barrel to the shroud provides for inconsistencies in the placement of the barrel relative to the shroud from firing to firing. Thus, with the prior art arrangements, the barrel may at one time be perfectly concentric in the shroud and after firing may the next time be seated closer to one portion of the inner wall of the shroud than another portion. It is these inaccuracies that result in possible firing inaccuracies.

Another object in accordance with the invention, therefore, is to maintain this concentric relationship of the shroud to the barrel and further provide an increased tolerance between the barrel and shroud. In this way, with the centering arrangement of this invention and the increased tolerance there is far less likelihood of any contact points even on a local basis between the outer diameter of the barrel and the inner diameter of the shroud.

SUMMARY OF THE INVENTION

In accordance with the invention there is provided a combination including a firearm having a frame, a barrel extending from the frame, and a shroud having a bore for receiving the barrel to thereby surround the barrel along a substantial length thereof. The barrel preferably has an outer diameter less than the inner diameter of the shroud bore to provide a clearance therebetween. In the method of assembly the barrel is first secured to the frame and then the shroud is fitted over the barrel. The barrel has outer threads for receiving a barrel to shroud nut. The nut and shroud have engaging alignment surfaces for holding the barrel concentrically within the shroud bore. The shroud preferably has an annular nut-receiving channel at the outer end of the shroud bore contiguous with the bore overlying the barrel outer threads and having a tapered end wall forming a seat for a similarly tapered wall of the nut. In an alternative embodiment of the invention instead of having tapered walls, the shroud has a concave seat for receiving a like convex wall of the nut. It is also preferred in accordance with the invention to provide the nut with a face wall, so that when the nut is secured to the barrel, this wall is substantially flush with the front face of the shroud thus not providing any projecting parts extending from the shroud.

With the use of either the tapered or the spherical seating arrangement, the barrel is concentrically disposed within the shroud bore with essentially the same clearance all around the barrel between the barrel and the shroud. Because the barrel may heat and expand, especially under rapid fire, there is a clearance provided between the barrel and shroud. Because of this clearance space, there is no contact at any point between the barrel and shroud and thus even during rapid firing there should not be any degradation of the firing accuracy.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a side elevation view of the hand gun incorporating the principles of the present invention;

FIG. 2 is an end view taken along line 2—2 of FIG. 1;

FIG. 3 is a cross-sectional fragmentary view taken along line 3—3 of FIG. 2;

FIG. 4 is a perspective view of the preferred embodiment of the securing nut; and FIG. 5 is a further fragmentary cross-sectional view similar to the one shown in FIG. 3 for an alternate embodiment of the invention.

DETAILED DESCRIPTION

In the drawings, FIGS. 1–4 show a preferred embodiment of the present invention. FIG. 5 is a fragmentary cross-sectional view showing an alternate embodiment. In FIG. 1 there is shown a hand gun which generally comprises a hand grip 10, a trigger 12, a trigger guard 14, hammer 16, cylinder 18, frame 20, and barrel 22. Other components of the firearm shown in FIG. 1 include a cylinder latch 24, a front sight 26, and a rear sight 28. The front sight 26 is supported, for example, by means of a pin 27 shown in FIG. 3, on the shroud 30.

The barrel 22 has a rear end 22A which may be threaded with the frame 20 for providing the primary support for the barrel 22. The front end 22B of the barrel is threaded and is clearly depicted in FIG. 3 along a short length thereof which may be on the order of a one-half inch length and is for receiving the securing nut 34. As noted in FIG. 3, the nut 34 is preferably dimensioned so that its outer face 35 is flush with the front face 36 of the shroud 30, or in other words, the nut 34 is substantially recessed in a channel 38 provided at the very outer end of the bore 40 of the shroud. The nut 34 is of annular shape as clearly depicted in FIG. 4 having diametrically opposite slots 43 (also note FIG. 2) for facilitating the tightening of the nut 34 on the barrel end 22B. A bifurcated tightening tool may be used for tightening the nut 34.

As noted in FIG. 3 there is a slight clearance space between the outer diameter of the barrel 22 and the inner diameter of the bore 40 in the shroud. Also, as noted in FIG. 3 the nut 34 is provided with an annular tapered or chamfered surface 48 that seats against a bottom tapered wall 39 terminating the end of channel 38. The cooperative action of the nut at its surface 48 with the tapered seat 39 provides a centering action so as to center the barrel 22 within the bore 40 concentric thereto and with substantially the same clearance space all around the barrel between the barrel and shroud bore.

FIG. 5 shows an alternate embodiment of the present invention. In FIG. 5 like reference characters will be used to identify the same parts previously shown in FIG. 3. Thus, in the embodiment of FIG. 5 there is provided a shroud 30 extending over the barrel 22 with the nut 34A engaging with the threaded end 22B of the barrel. In this embodiment the nut 34A is also provided with diametrically disposed slots 43A for securing the nut in place on the barrel. In this embodiment the centering is provided by virtue of the cooperative engagement between a convex annular surface 50 on the inner side of the nut 34A, and an annular concave surface 52 forming the terminating end of channel 38. In accordance with still another embodiment of the invention not described herein, the concavity may be provided in the nut around its circumference while the convex surface is disposed in the end channel wall. In either instance and also in the embodiment of FIG. 3 means are provided for interlocking between the nut and the shroud to cause this concentric alignment between the barrel and the shroud bore.

In the prior art arrangements it is common to have a clearance between the barrel and shroud on the order of 0.004–0.006 inches. This clearance represents a difference in diameter between the inner diameter of the bore and the outer diameter of the barrel taken at some predetermined point along the barrel. However, in accordance with the invention it is preferred that this clearance be increased to on the order of 0.025–0.030 inches. This clearance may be slightly less but should be at least 0.010 inches.

What is claimed is:

1. In combination, a revolver having a frame, a barrel extending from the frame, a shroud having a bore for receiving the barrel to thereby surround the barrel along a substantial length thereof, said barrel having an outer diameter just less than the inner diameter of the shroud bore to provide a clearance fit therebetween, said barrel having outer threads for receiving a barrel to shroud nut, said nut and shroud having engaging alignment surfaces including a seat for the nut in the shroud for aligning the barrel concentrically within the shroud bore and maintaining this alignment from firing to firing even though there may be temporary disengagement between the alignment surfaces during a firing.

2. A combination as set forth in claim 1 wherein said shroud has an annular nut-receiving channel at the outer end of the shroud bore contiguous with the bore overlying the barrel outer threads and having a tapered end wall forming a seat for a similarly tapered wall of the nut.

3. A combination as set forth in claim 2 wherein a face wall of the nut when secured to the barrel is substantially flush with the front face of the shroud.

4. A combination as set forth in claim 2 wherein said channel has a depth substantially the same as the width of the nut.

5. A combination as set forth in claim 1 wherein said shroud has an annular nut-receiving channel at the outer end of the shroud bore contiguous with the bore overlying the barrel outer threads and having a concave seat for receiving a like convex wall of the nut.

6. A combination as set forth in claim 5 wherein the concave seat is partially spherical shaped and the convex wall is partially spherical shape.

7. A combination as set forth in claim 1 wherein the engaging alignment surfaces are both tapered at an angle to the centerline of the barrel and shroud bore.

8. A combination as set forth in claim 1 wherein the engaging alignment surfaces include a concave surface and a convex similarly shaped surface.

9. A combination as set forth in claim 1 wherein said shroud has an annular nut-receiving channel at the other end of the shroud bore contiguous with the bore overlying the barrel outer threads and having a conical end wall forming a seat for a similarly shaped wall of the nut.

10. A combination as set forth in claim 1 wherein the clearance between the shroud inner bore and the parallel outer diameter is greater than 0.006 inch.

11. A combination as set forth in claim 10 wherein said clearance is at least 0.010 inch.

12. A combination as set forth in claim 11 wherein the tolerance is on the order of 0.025–0.030 inch.

13. A combination as set forth in claim 1 wherein said shroud has an annular nut-receiving channel at the outer end of the shroud bore contiguous with the bore and extending radially outwardly from the shroud bore.

* * * * *